United States Patent [19]

Alcini et al.

[11] Patent Number: 4,698,473

[45] Date of Patent: Oct. 6, 1987

[54] REFRACTORY METAL-LINED INDUCTION COIL

[75] Inventors: William V. Alcini, Ypsilanti; Steven L. Avery, Saginaw, both of Mich.

[73] Assignee: General Motors Corporation, Detroit, Mich.

[21] Appl. No.: 858,735

[22] Filed: May 2, 1986

[51] Int. Cl.[4] ..... H05B 6/44

[52] U.S. Cl. ..... 219/10.79; 219/10.49 R; 336/84 C; 336/222

[58] Field of Search ..... 219/10.79, 7.5, 9.5, 219/10.43, 10.49 R, 10.67; 336/177, 222, 84 C, 199, 207

[56] References Cited

U.S. PATENT DOCUMENTS

| | | | |
|---|---|---|---|
| 2,777,041 | 1/1957 | Dustman | 219/10.79 |
| 3,258,573 | 6/1966 | Morin et al. | 219/7.5 |
| 3,612,806 | 10/1971 | Lewis et al. | 219/10.79 |
| 4,021,274 | 5/1977 | Chadwick | 148/146 |
| 4,207,451 | 6/1980 | Tudbury | 219/10.79 |

OTHER PUBLICATIONS

American Society for Metals, *Metals Handbook,* Ninth Edition, vol. 4, "Heat Treating" (1981), pp. 458–461.

*Primary Examiner*—Philip H. Leung
*Attorney, Agent, or Firm*—Douglas D. Fekete

[57] ABSTRACT

An improved induction coil of a type used in heat treating metal workpieces comprises a protective lining bonded to a copper coil, which lining is formed preferably of a substantially molybdenum alloy.

2 Claims, 3 Drawing Figures

REFRACTORY METAL-LINED INDUCTION COIL

BACKGROUND OF THE INVENTION

This invention relates to a durable induction coil for heat treating metal workpieces. More particularly, this invention relates to an induction coil formed of copper and comprising a refractory metal cladding protecting a workpiece-facing surface to extend coil life with minimal loss of inductive heating efficiency.

A surface of a steel workpiece may be hardened by electromagnetic inductive heating and quenching. An alternating electrical current through an electrically conductive coil creates a rapidly fluctuating magnetic field, which in turn induces current in a workpiece within the field. This induced current is concentrated near the workpiece surface and resistively heats the surface. Because field strength is inversely proportional to distance from the inductor, it is desired to position the workpiece proximate to the coil, while maintaining an insulative spacing therebetween, to maximize heating but avoid arcing.

Conventionally, the induction coil is formed of copper, which has a low electrical resistivity, typically less than two microohm centimeters for commercial grades, to minimize resistive heating within the coil. However, because of the proximate placement, heat radiated from the workpiece heats adjacent coil surfaces to a temperature sufficient to oxidize the copper. Although typically coolant is circulated through the coil, this has not been entirely satisfactory to eliminate corrosion as a main reason for coil failure. Also, arcing that may occur between the coil and the workpiece pits the copper surface. Occasional collisions while positioning the workpiece near the coil causes wear and further shortens coil life.

It is an object of this invention to provide an improved induction coil having an extended useful life, which coil comprises a protective thin refractory metal lining on workpiece-adjacent surfaces to reduce corrosion, pitting and wear that would otherwise shorten the life of the coil. The lining is formed of a refractory metal having a resistivity which, although not as low as that of copper, is sufficient to minimize electrical losses due to the lining so as to maintain inductive heating efficiency.

SUMMARY OF THE INVENTION

In a preferred embodiment, a durable inductor of this invention comprises a helical copper coil formed to define a space for receiving a workpiece. The coil is adapted for connection to an electrical power source to carry an alternating electrical current for inductively heating the workpiece. The inductor further comprises a thin lining of a low resistivity molybdenum alloy bonded to an inner coil surface facing the workpiece. Although the lining may conduct a portion of the current and may be exposed to the electromagnetic field generated by current conducted through the copper coil, the low resistivity of the molybdenum alloy, preferably less than about 7 microohm centimeters, minimizes resistive heating, which would otherwise reduce the electrical efficiency of the inductor. The molybdenum alloy lining protects the underlying copper from potentially corrosive exposure to air and itself exhibits a suitable high temperature oxidation resistance to inhibit corrosion at operating temperature. In addition to resisting corrosion, the protective molybdenum strip also reduces wear and pitting. Thus, the refractory metal lining provided in accordance with this invention extends the useful life of the inductor with minimal adverse effect upon inductive heating operations.

DESCRIPTION OF THE DRAWINGS

The present invention will be further illustrated with reference to the accompanying drawings wherein.

DETAILED DESCRIPTION OF THE INVENTION

Figure 1:
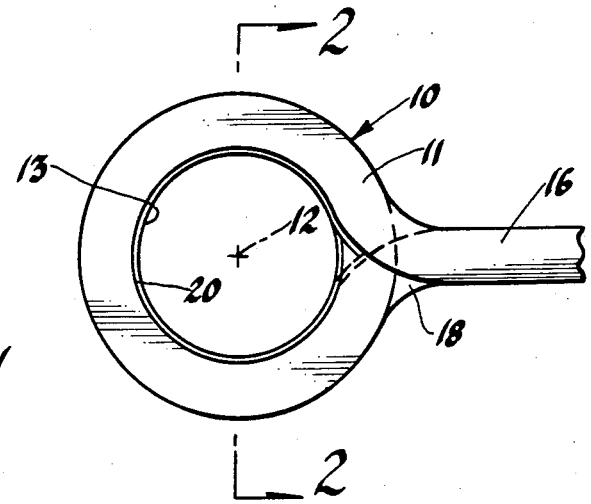
FIG. 1 is a plan view of an induction coil of this invention.
Figure 2:
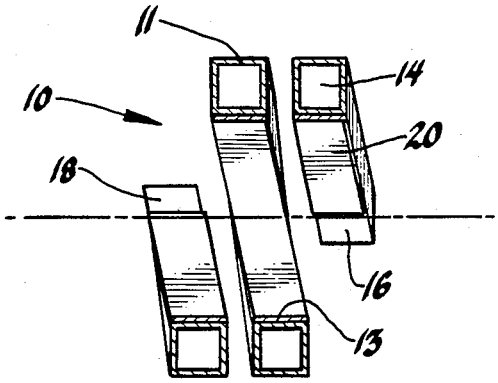
FIG. 2 is a cross-sectional view of the induction coil in FIG. 1 taken along the line 2—2 looking in the direction of the arrows.
Figure 3:
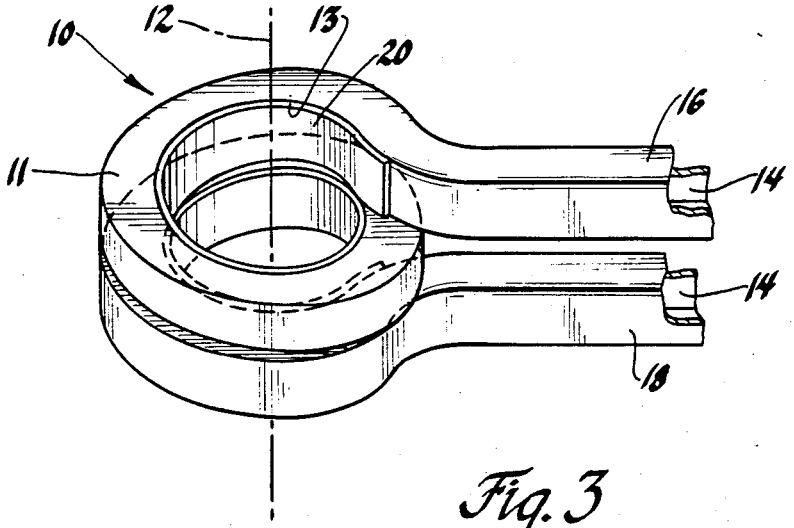
FIG. 3 is a perspective view of the induction coil in FIG. 1.

Referring to the Figures, a preferred induction coil 10 of this invention comprises a tubular copper coil 11 helically wound about an axis 12 so as to define a cylindrical space suitable for receiving a metal workpiece. Copper tube 11 features a square cross section, an inner side 13 of which faces the workpiece-receiving space and parallels axis 12. Coil 11 defines a central passage 14 for circulating water coolant. Coil 11 also comprises radially extending terminals 16 and 18 suitable for water line and electrical connections.

Coil 10 is formed of a commercial grade copper having a low electrical resistivity, preferably less than two microohm centimeters, to minimize resistive heating by current conducted therethrough. In accordance with this invention, the inner coil surface 13 carries a protective strip 20. Strip 20 is preferably formed of TZM alloy consisting essentially of 0.5 weight percent titanium, 0.1 weight percent zirconium, 0.02 weight percent carbon and the balance substantially molybdenum. The TZM alloy exhibits an electrical resistivity of about 6.7 microohm centimeters. The strip thickness is about 0.02 inch. Strip 20 is bonded to the copper surface by silver solder. A preferred silver solder compound is an alloy comprising about 28 weight percent copper and the balance substantially silver and is designated grade BAg8A by the American Welding Society. Prior to forming the coil, the faying surface of strip 20 is coated with the solder compound, placed against the copper surface, heated to a temperature sufficient to melt the solder, and cooled to form an integral solder bond between tube 11 and strip 20, whereafter the bonded assembly is wound to shape coil 10. Alternately, the tube may be formed first into the configuration of coil 11. After coiling, the solder compound is applied to inner surface 13, strip 20 overlaid, and the assembly is heated and cooled to produce the desired solder bond.

During heat treatment operations, terminals 16 and 18 are suitably connected to water lines for introducing and discharging water to cause the water to circulate through passage 14. Terminals 16 and 18 are also connected to opposite poles of a radio frequency alternating current electrical power source, thereby creating a magnetic field within induction coil 10. A metal workpiece axially inserted into coil 10 is subjected to the fluctuating magnetic field, whereupon currents induced in the workpiece heat the surface thereof. The heated workpiece is axially removed and quenched to complete treatment. Coil 11 and strip 20 are in electrical communication through the solder bond. Furthermore, because the inner face forms the shortest path through such a coil, the electrical current tends to concentrate in strip 20 and the adjacent coil side 13. Thus, although it is expected that the major portion of the total current is conducted through the low resistivity copper, current also flows through strip 20. However, the thinness and suitably low electrical resistivity of TZM strip 20 diminish resistive heating by the current conducted through the strip. Similarly, any resistive heating that results because strip 20 lies within the field created by the applied current conducted through coil 11 is reduced. Thus, the loss of electrical power attributed to strip 20 is minimal.

In comparison to a bare copper surface, refractory strip 20 provided in accordance with this invention substantially prolongs the useful life of the coil. Heat radiated by the workpiece heats strip 20. However, oxidation of the molybdenum alloy at the elevated temperatures is substantially reduced, particularly in comparison to copper. Also, the molybdenum strip reduces damage as a result of occasional collisions during insertion or removal of a workpiece from the coil. Still further, the molybdenum strip is more resistant to pitting in the event of arcing between coil 10 and the workpiece.

In the described embodiment, the lining of the induction coil of the invention is formed of a substantially molybdenum alloy, specifically TZM alloy. The electrical resistivity of elemental molybdenum is about 5.35 microohm centimeters. In general, an addition of an alloying metal to molybdenum increases electrical resistivity. Thus, it is desired to minimize such alloying additions, preferably so as not to exceed a resistivity of about 7 microohm centimeters. Preferred TZM alloys contain between about 0.4 and 0.6 weight percent titanium, between about 0.06 and 0.1 weight percent zirconium, and between about 0.01 and 0.03 weight percent carbon, the balance being molybdenum and unavoidable impurities. TZM also exhibits workability sufficient to permit the lining to be readily formed to the helical configuration corresponding to the surface of the copper coil. In addition, the high temperature oxidation resistance, wear resistance and strength of a molybdenum-base alloy make it particularly useful for a protective coil lining at temperatures typical of inductive heat treatment operations. Tungsten or substantially tungsten alloys exhibit similar properties and are believed to be also suitable for forming a coil lining.

Although this invention has been described in terms of an induction coil having a helical configuration, the coil may have any suitable configuration. Suitable configurations include coil designs depicted in *Metals Handbook, 9th Edition, Vol.* 4, *Heat Treating,* page 459, published by The American Society for Metals, in 1981. A refractory lining in accordance with this invention is applied to a coil surface radiantly heated by the workpiece during induction heating, that is, a surface facing a workpiece after positioning within the electromagnetic field.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A durable inductor for heating a metal workpiece, said inductor comprising a copper coil suitable for conducting an alternating electrical current to create a fluctuating magnetic field for inductively heating a workpiece within said field, said copper coil having a surface oriented to face a workpiece within said field during heating, and a protective metal lining bonded to said workpiece-facing copper coil surface and substantially composed of a metal selected from the group consisting of molybdenum and tungsten.

2. A durable inductor for heating a metal workpiece to effectuate treatment thereof, said inductor comprising a helical tubular copper coil sized and shaped for encircling a space for receiving a workpiece and comprising end terminals for connection to opposite poles of an alternating current electrical power source, whereupon an alternating current conducted through said coil generates a fluctuating magnetic field within said space suitable for heating a workpiece therein, said coil defining a longitudinal passage for circulating coolant therethrough, said coil having a side facing said workpiece-heating space, and a protective refractory metal lining bonded to said workpiece-facing copper coil side and formed of a substantially molybdenum alloy having an electrical resistivity less than about 7 microohm centimeters.

* * * * *